US008161590B2

(12) United States Patent
Feeg et al.

(10) Patent No.: US 8,161,590 B2
(45) Date of Patent: Apr. 24, 2012

(54) APPARATUS FOR CLEANING AND SANITIZING SHOES

(75) Inventors: Mark Feeg, Sinking Spring, PA (US); Neil Vojtasek, Reading, PA (US)

(73) Assignee: Berks Boys Company, LLC, Reading, PA (US)

( * ) Notice: Subject to any disclaimer, the term of this patent is extended or adjusted under 35 U.S.C. 154(b) by 1044 days.

(21) Appl. No.: 12/103,704

(22) Filed: Apr. 15, 2008

(65) Prior Publication Data

US 2008/0256728 A1 Oct. 23, 2008

Related U.S. Application Data

(60) Provisional application No. 60/912,667, filed on Apr. 18, 2007.

(51) Int. Cl.
*A47L 23/02* (2006.01)

(52) U.S. Cl. ..... 15/34; 15/36; 15/161; 15/112

(58) Field of Classification Search ..... 15/34, 36, 15/161, 106, 104.92, 30, 112
See application file for complete search history.

(56) References Cited

U.S. PATENT DOCUMENTS

| | | | | |
|---|---|---|---|---|
| 732,373 | A | 6/1903 | Preuss | |
| 846,020 | A | 3/1907 | Feld | |
| 1,952,222 | A | 3/1934 | Rostoker | |
| 2,895,159 | A | 7/1959 | Ostrow | |
| 3,802,021 | A | 4/1974 | Schulz | |
| 3,849,822 | A | 11/1974 | Ouellette | |
| 4,358,867 | A | 11/1982 | Berta | |
| 4,724,564 | A | 2/1988 | Fresh | |
| 4,866,805 | A | 9/1989 | Oden | |
| 4,918,779 | A * | 4/1990 | Burns | 15/104.92 |
| 4,922,578 | A | 5/1990 | Miettinen | |
| 5,950,269 | A | 9/1999 | Openshaw | |
| 6,584,636 | B2 | 7/2003 | Schlem | |
| 6,813,795 | B2 | 11/2004 | Graves | |
| 6,912,752 | B2 | 7/2005 | Ferrari | |
| 7,621,234 | B2 * | 11/2009 | Roy | 119/628 |

* cited by examiner

*Primary Examiner* — Shay Karls
(74) *Attorney, Agent, or Firm* — Miller Law Group, PLLC

(57) ABSTRACT

A shoe cleaning apparatus is formed with a series of rotary brushes operable to clean the bottom of a shoe placed thereon and spring-loaded linear side brushes to clean the sides of the shoe. A supply of cleaning or sanitizing fluid is retained in an elevated tank that feeds by gravity into the rotary brushes for application to the bottom of the shoe being cleaned. The flow of fluid is actuated by downward pressure on a hinged sub-frame that opens a valve. Each rotary brush is engaged by a comb that cleans the brushes upon rotation thereof. A removable debris tray is mounted within the frame to collect dirt and debris removed by the combs and to collect the cleaning fluid dispensed from the elevated tank. Resistance to the downward pressure is provided by springs to minimize accidental opening of the flow valve.

17 Claims, 7 Drawing Sheets

APPARATUS FOR CLEANING AND SANITIZING SHOES

CROSS-REFERENCE TO RELATED APPLICATIONS

This application claims domestic priority on U.S. Provisional Patent Application Ser. No. 60/912,667, filed Apr. 18, 2007, the contents of which are incorporated herein by reference.

FIELD OF THE INVENTION

This invention relates to a device for cleaning dirt and debris from the bottom and sides of shoes and, more particularly, to an apparatus that includes a sanitizing spray operable in conjunction with the exertion of foot pressure during cleaning operation to sanitize the bottom and sides of the shoes being cleaned.

BACKGROUND OF THE INVENTION

Footwear, such as shoes and boots, collects dirt and debris from use in the outdoors. The simple door mat is provided at most dwellings to provide an apparatus for cleaning the soles of the shoes being worn by people entering the dwelling. Door mats are not very effective at removing dirt and debris, such as grass, snow, sand, etc., embedded in the treads of such shoes. Door mats eventually get dirty and become less effective in removing dirt. Mechanical devices for cleaning footwear have been developed, but have not proven to be effective in both cleaning and sanitizing the bottom and sides of the shoes or boots being cleaned.

An early example of a mechanical shoe cleaning device can be found in U.S. Pat. No. 732,373, granted to Andrew Preuss on Jun. 30, 1903, which discloses a mechanically driven set of horizontally disposed roller brushes to clean shoes. The weight of the person depresses a frame which causes rotation of the rollers in one direction to scrub against the bottom of the shoe. The return of the frame drives the rollers backwards to also clean the shoe bottom as the shoe is being removed from the frame. Similarly, U.S. Pat. No. 846,020, granted to Samuel Feld on Mar. 5, 1907, has a set of horizontally disposed rotatable brushes that are powered to scrub the soles of shoes placed thereon.

U.S. Pat. No. 1,952,222, issued to Louis Rostoker on Mar. 27, 1934, teaches a door mat structure in which a plurality of roller brushes is rotatably supported for rotation against the bottom of the shoe. Metal bars with toothed or serrated edges are engagable with the roller brushes to dislodge dirt therefrom to drop into the pan below the brushes. In U.S. Pat. No. 2,895,159, issued to Henry Ostrow on Jul. 21, 1959, a door mat is configured with a series of horizontally disposed rollers that are driven by a crank mechanism to reciprocate laterally in a scrubbing motion to clean the bottom of the shoe. A series of horizontally disposed rollers are also driven by a crank mechanism to effect a scrubbing of the sole of the shoe placed thereon in U.S. Pat. No. 3,802,021 granted on Apr. 9, 1974, to Hans-Joachim Schulz.

A plurality of powered horizontal roller brushes scrubs the bottom of a shoe for cleaning purposes in U.S. Pat. No. 3,849,822 granted to Gerard Ouellette on Nov. 26, 1974. The use of a lower roller engagable with a non-powered rotary brush that removes dirt from the bottoms of shoes is disclosed in U.S. Pat. No. 4,358,867, issued on Nov. 16, 1982, to Sophia Berta, while a liquid-holding tray provides a cleaning fluid for application against the bottom of the shoe during the cleaning operation. The shoe cleaning apparatus in U.S. Pat. No. 4,724,564 issued to Elwyn Fresh on Feb. 16, 1988, utilizes a single rotary brush that is powered in rotation, along with a reciprocating flat brush, to clean the bottom of a shoe.

U.S. Pat. No. 4,866,805, issued to Willie Oden on Sep. 19, 1989, provides a liquid containing tray in which a sole scrubbing mat is laid to clean and sanitize the shoe sole engaged with the mat. An elaborate roller brush mechanism is powered to rotate against the bottom of the shoe in U.S. Pat. No. 4,922,578, granted on May 8, 1990, to Veli Miettinen. The powered brushes in U.S. Pat. No. 5,950,269, granted to Deryl Openshaw on Sep. 14, 1999, are oriented longitudinally, instead of transversely, to be powered for the scrubbing of the sole of shoes placed thereon.

The shoe cleaning apparatus in U.S. Pat. No. 6,584,636 issued to Jon Schlem on Jul. 1, 2003, combines a pressurized water spray with brushes to clean the bottoms of shoes. U.S. Pat. No. 6,912,752, granted on Jul. 5, 2005, to Luciano Ferrari, utilizes a plurality of brushes for cleaning the bottoms of shoes along with jets of air and jets of disinfecting solution. In U.S. Pat. No. 6,813,795, issued to Judy Graves on Nov. 9, 2004, provides for a removable tray that collects dirt and debris dislodged from the shoes during the cleaning process.

It would be desirable to provide an effective shoe cleaning device that can be manufactured and sold at a cost that can be afforded by the general public, yet is not complicated in operation or construction, while providing superior cleaning effectiveness.

SUMMARY OF THE INVENTION

It is an object of this invention to provide an effective shoe cleaning device that will provide superior shoe cleaning ability without resorting to complex operation or construction.

It is another object of this invention to provide a shoe cleaning apparatus that will sanitize the bottoms and sides of the shoe while the shoe is being cleaned.

It is an advantage of this invention that debris is removed from the bottom and sides of a person's shoes before passing through an entryway.

It is a feature of this invention that the shoe cleaning device can be located next to an entryway to be utilized before passing through the entryway.

It is another feature of this invention that the shoe cleaning device does not require external connection to electrical power to enable operation thereof.

It is another advantage of this invention that the shoe cleaning apparatus can remove grass, snow, and dirt embedded into the treads of shoes.

It is still another feature of this invention that the dirt and debris removed from the shoes being cleaned is removed from the cleaning apparatus without reengaging the shoes being cleaned.

It is yet another feature of this invention that the shoe cleaning apparatus utilizes a series of parallel rotary brushes to clean the bottom of shoes placed thereon.

It is still another feature of this invention that each rotary brush is cooperatively engaged with a comb to clean the dirt and debris from the rotary brush before being rotated back into engagement with the bottom of the shoe being cleaned.

It is still another advantage of this invention that a flow of sanitizing fluid can be directed into the interior of the rotary brushes to be applied to the bottom of the shoes being cleaned.

It is still another object of this invention to provide an actuation device to initiate the flow of cleaning fluid into the center of the rotary brushes in response to downward pressure exerted by the placement of a shoe onto the rotary brushes.

It is yet another advantage of this invention that the flow of cleaning or sanitizing fluid into the center of the rotary brushes is via a gravity feed through a valve opened by downward pressure by the shoe being cleaned.

It is a feature of this invention that springs provide resistance to downward pressure that opens the valve controlling the flow of solution into the rotary brushes.

It is still another feature of this invention that side brushes are provided above the rotary brushes to affect a cleaning of the sides of the shoe while being rubbed against the rotary brushes.

It is a further advantage of this invention that the side brushes can be spring-loaded to urge the side brushes into engagement with the sides of the shoe being cleaned.

It is yet another object of this invention to provide a shoe cleaning apparatus for effectively cleaning the bottom and sides of a shoe placed thereon, which is durable in construction, inexpensive of manufacture, carefree of maintenance, facile in assemblage, and simple and effective in use.

These and other objects, features and advantages are accomplished according to the instant invention by providing a shoe cleaning apparatus having a series of rotary brushes operable to clean the bottom of a shoe placed thereon and spring-loaded linear side brushes to clean the sides of the shoe. A supply of cleaning or sanitizing fluid is retained in an elevated tank that feeds by gravity into the rotary brushes for application to the bottom of the shoe being cleaned. The flow of fluid is actuated by downward pressure on a hinged subframe that opens a valve. Each rotary brush is engaged by a comb that cleans the brushes upon rotation thereof. A removable debris tray is mounted within the frame to collect dirt and debris removed by the combs and to collect the cleaning fluid dispensed from the elevated tank. Resistance to the downward pressure is provided by springs to minimize accidental opening of the flow valve.

BRIEF DESCRIPTION OF THE DRAWINGS

The advantages of this invention will become apparent upon consideration of the following detailed disclosure of the invention, especially when taken in conjunction with the accompanying drawings wherein.

DETAILED DESCRIPTION OF THE PREFERRED EMBODIMENT

Figure 1:
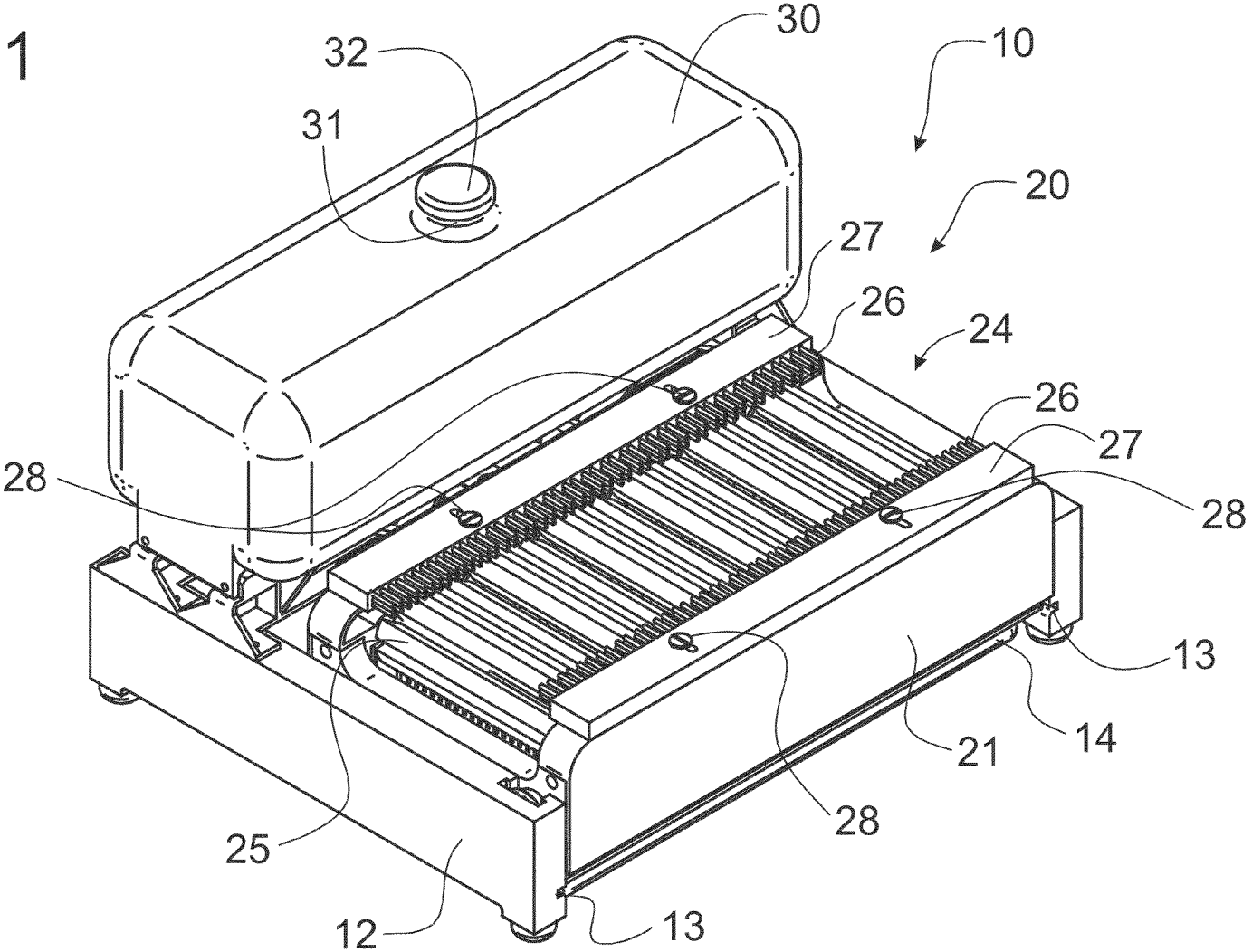
FIG. 1 is a perspective view of a shoe cleaning apparatus incorporating the principles of the instant invention.
Figure 2:
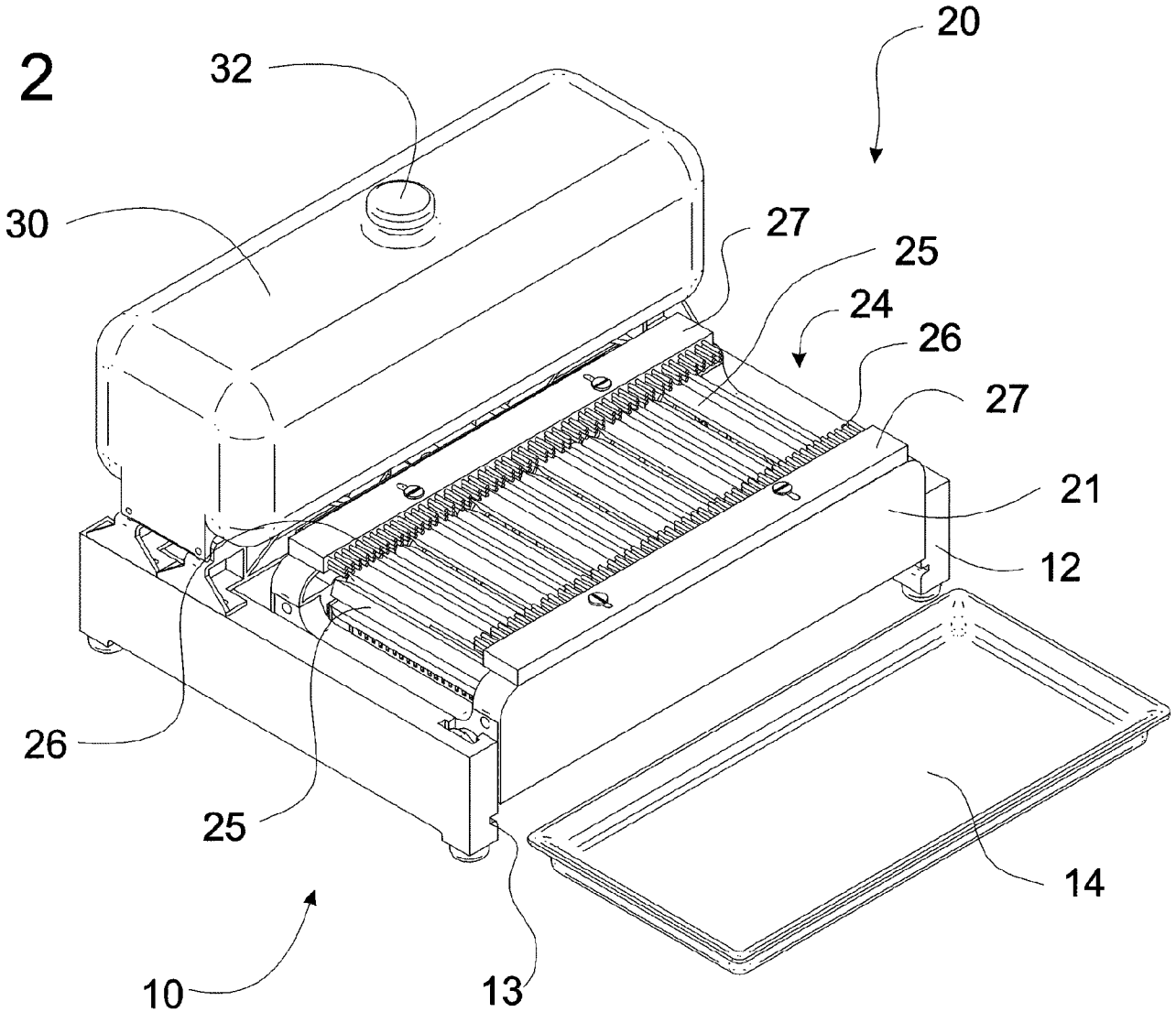
FIG. 2 is a perspective view of the shoe cleaning apparatus as depicted in FIG. 1, but showing the selective removal of a dirt collection tray from underneath the rotatable brushes.

Referring first to FIGS. 1-4, a shoe cleaning apparatus incorporating the principles of the instant invention can best be seen. The shoe cleaning apparatus 10 is intended to be positioned on a flat surface outside an entryway into a building or positioned outside any entryway that is located inside a building. The entryway could be any door or entrance into a residential structure, such as house, tent, or RV, or into a commercial or industrial building. The shoe cleaning apparatus 10 could also be utilized at a location inside a building where dirt and/or germs from shoes are desired to be cleaned or sanitized from the shoes before entering a "cleaner" area (e.g., a garage to living area in the house, workshop to living area in the house, manufacturing area to office area in an industrial setting, etc.). The shoe cleaning apparatus 10 is preferably disposed at a location that is convenient to access and proximate to the entryway to be able to affect a cleaning of footwear before passing through the entryway.

The shoe cleaning apparatus 10 is formed with a generally rectangular frame 12 serving as the base for the apparatus 10. The frame 12 is preferably formed from molded plastic, such as injection molded plastic, to provide a sturdy and durable base for the operation of the shoe cleaning apparatus 10. The frame 12 supports a rotatable brush assembly 20 and a cleaning solution container 30 mounted above the brush assembly 20 to permit a gravity feed for the cleaning solution in the container 30 into the brush assembly 20, as will be described in greater detail below.

The brush assembly 20 is pivotally supported in the frame 12 with the pivot 22 being located on the side of the brush assembly 20 remote from the solution container 30. The brush assembly 20 is formed with a subframe 21 that is carried by the pivot 22 for pivotal movement relative to the frame 12. In the subframe 21, a plurality of brushes 25 are rotatably supported in the subframe 21 for rotation about respective axes of rotation that are generally horizontally disposed across the subframe 21. Preferably, the subframe 21 can be disassembled at one side thereof to permit a release of the brushes 25 and allow a selective replacement thereof when desired. Preferably, the brush assembly 20 will utilize approximately 6 cylindrical brushes oriented in a generally horizontal plane to define a cleaning surface 24 on the upper side thereof.

The brush assembly 20 is also preferably formed with a pair of opposing stationary side cleaning brushes 26 affixed to the subframe 21 above the cleaning surface 24 to engage the opposing sides of the shoes being cleaned while being engaged with the rotating cylindrical brushes 25 defining the cleaning surface 24. These side cleaning brushes 26 function to clean the sides of the shoes as the shoe is moved over the cleaning surface 24; however, the stationary side cleaning brushes 26 also serve to keep the solution applied from the cleaning solution container 30 to the cleaning surface 24, as will be described in greater detail below, from splashing upwardly past the sides of the shoe being cleaned.

Preferably the side cleaning brushes 26 are secured to the subframe 21 by fasteners passing through slotted openings 28 in the rigid mounting members 27 to allow a selective positioning of the side cleaning brushes 26 relative to the subframe 21 and the cleaning surface 24 so that the side cleaning brushes 26 can be located for proper engagement with the sides of shoes being cleaned on the cleaning surface 24. Alternatively, the side cleaning brushes 26 can be spring-loaded for movement inwardly toward one another to provide constant engagement with shoes of varying widths. Instead of the fasteners clamping the rigid mounting members 27 to the subframe 21, flat springs (not shown) would be anchored on the subframe 21 and urge the mounting members 27 inwardly over the cleaning surface 24.

The frame 12 carries a debris tray 14 slidably received within grooves 13 formed in the frame 12 to be positionable beneath the brush assembly 20 to receive dirt and debris dislodged from shoes cleaned thereby. The debris tray 14 is slidable within the grooves 13 to be removed from the frame 12 and allow the disposal of the collected dirt and debris. The debris tray 14 can be formed of any rigid material including metals, such as aluminum, or molded plastic. The tray 14 also collects cleaning solution from the cleaning process described in greater detail below. A drain (not shown) can be formed in the tray 14 to allow solution to be collected, or if removed from the tray, will allow excess solution or other moisture collected from the shoes collected in the tray 14 to be drained away from the apparatus 10. Preferably, the drain will be associated with a screen (not shown) to allow the liquid moisture and solution to drain out of the tray 14 while leaving solid material in the tray 14 for subsequent disposal.

Figure 5:
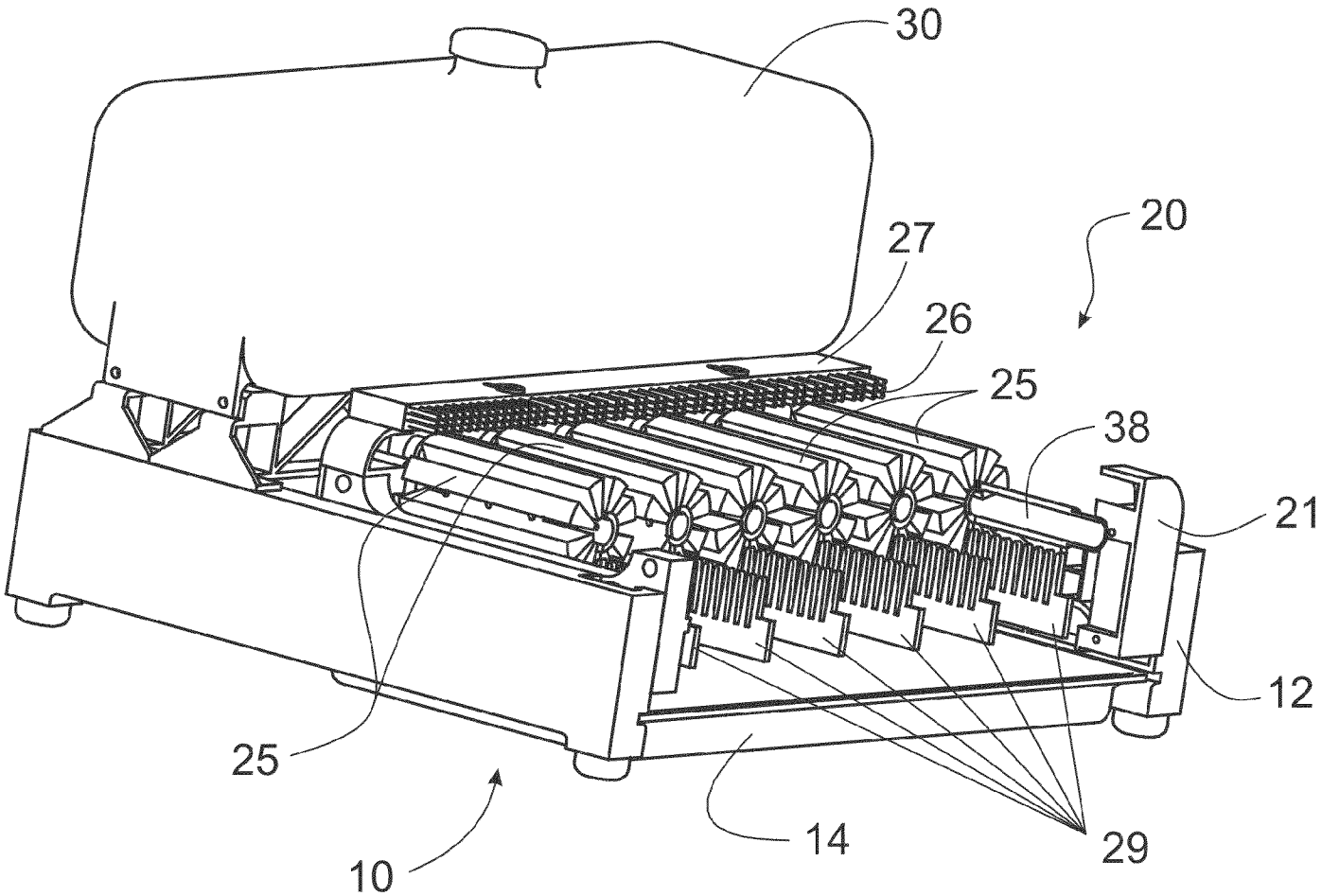
FIG. 5 is a partial perspective view of the shoe cleaning apparatus similar to that of FIG. 1, but having portions of the frame and rotating brush assembly broken away to show the brush cleaning combs positioned beneath the rotatable brushes.

As best seen in FIG. 5, the brush assembly 20 is also formed with cleaning combs 29 supported by the subframe 21 beneath the rotating cylindrical brushes 25. Alternatively, the cleaning combs 29 could be double-sided and positioned between adjacent cylindrical brushes 25 to be engagable with both adjacent brushes 25 simultaneously. In the configuration shown in FIG. 5, each cylindrical brush 25 is associated with a cleaning comb 29 so that the bristles of the brushes 25 run through the teeth of the combs 29. In this manner, any dirt and debris carried by the brushes 25 between the bristles will be cleaned from the brushes 25 and dropped vertically into the debris tray 14 immediately below the brush assembly 20. While the brushes 25 rotate during use, the combs 29 provide some rotational resistance to help increase the scrubbing action between the brush and the bottom of the shoe. Also, the combs help remove excess solution from the brushes, which in turn helps remove excess solution from the bottom of the shoes. Like the rotatable brushes 25, the cleaning combs 29 are mounted within the subframe 21 in a manner to permit the combs 29 to be selectively removed for replacement or cleaning.

Figure 3:
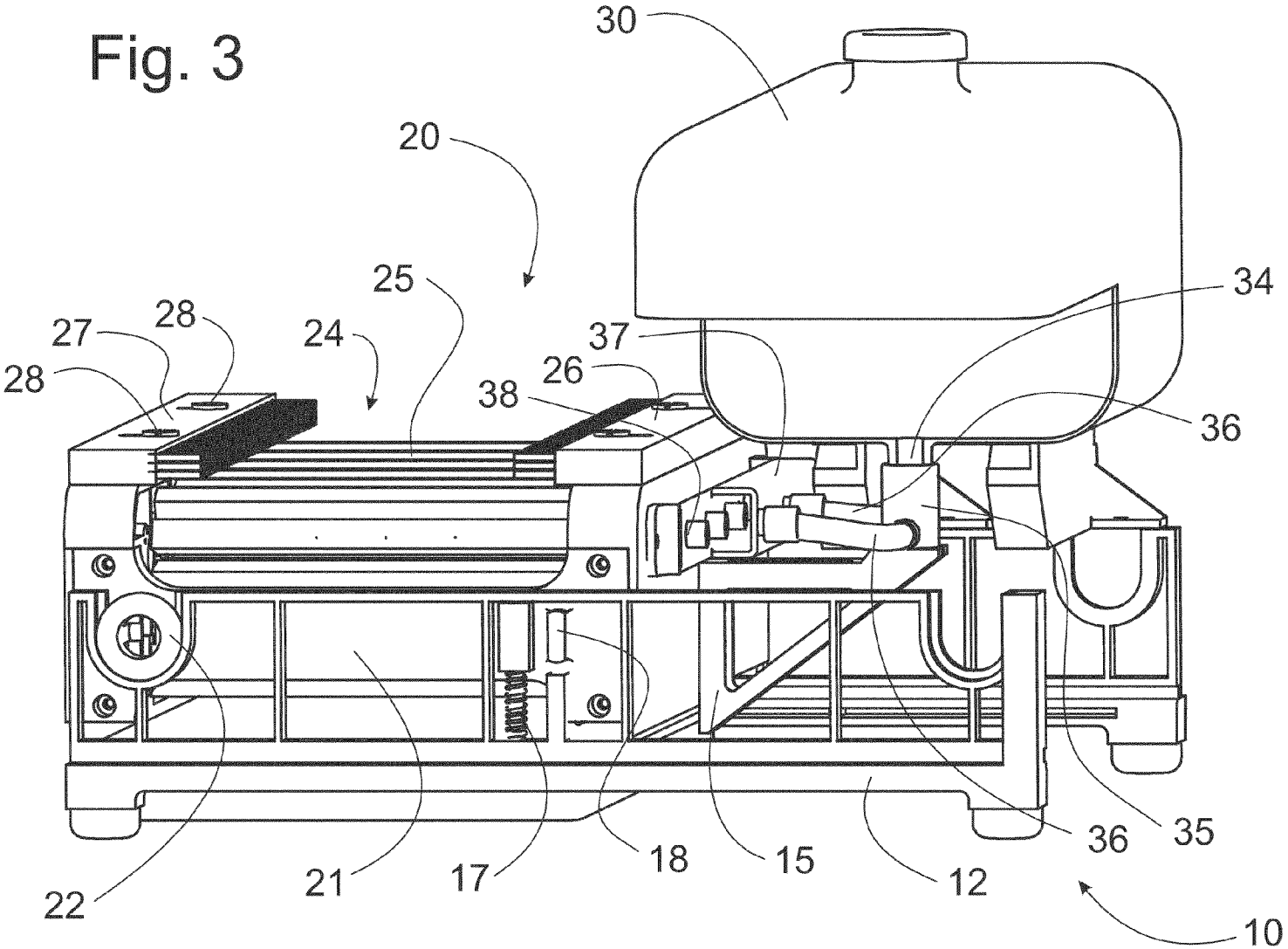
FIG. 3 is a perspective view of the shoe cleaning apparatus taken from an opposing side of the apparatus, as compared to the views of FIGS. 1 and 2, with portions of the solution container being broken away to better view the valve arrangement and the interconnection between the pivoted apparatus frame and the valve for the dispensing of cleaning solution into the rotating brush assembly.
Figure 4:
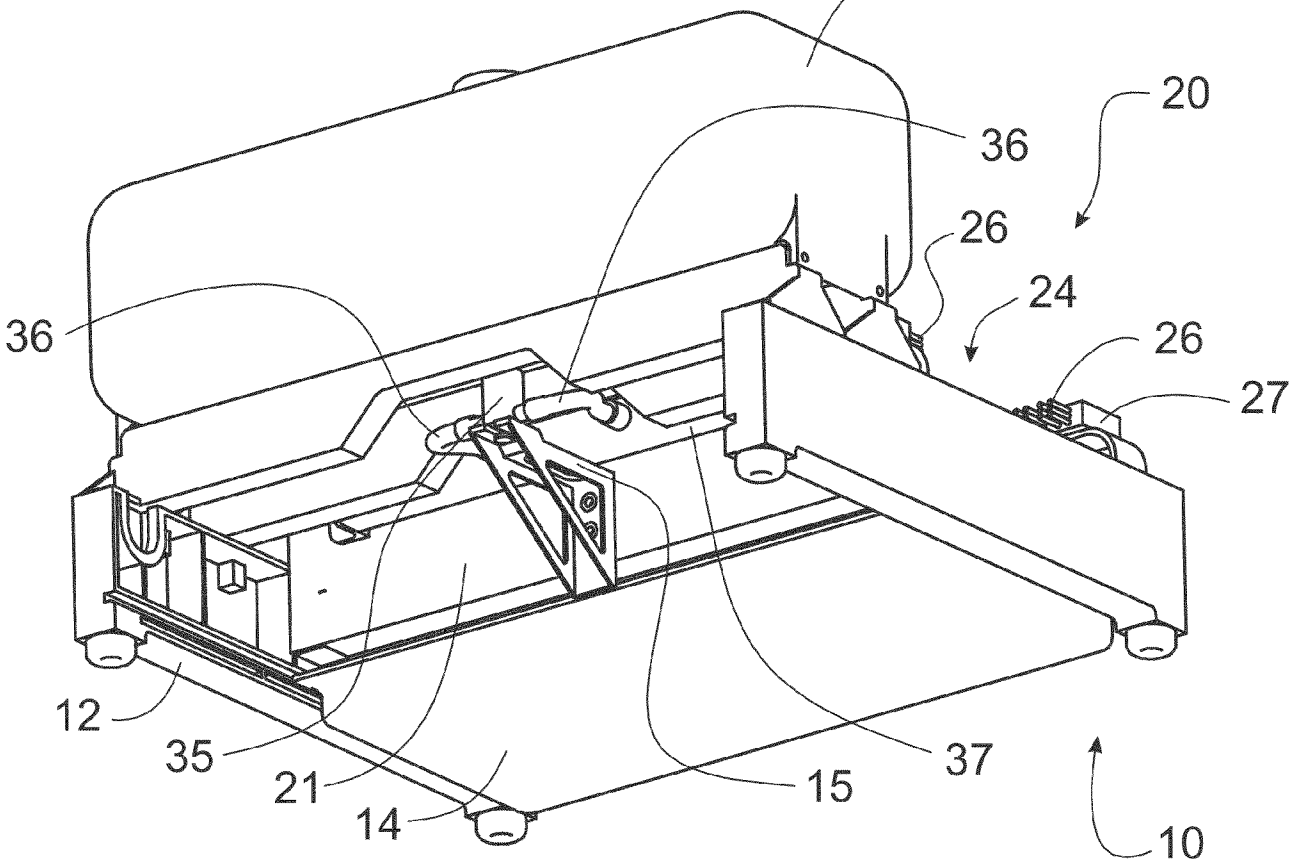
FIG. 4 is a perspective view of the shoe cleaning apparatus taken from below the frame to show the valve for the cleaning solution and the arrangement of the valve bracket for actuation of the valve for the dispensing of cleaning solution into the rotating brush assembly.

Returning to FIGS. 1-4, one skilled in the art will note that the frame 12 also supports a cleaning solution container 30 beside and above the brush assembly 20. The container 30 preferably is sized to hold about 1-2 gallons of cleaning and/or sanitizing solution, such as an alcohol based solution to help clean, sanitize, and prevent freezing when used in cold weather. The container prevents excessive evaporation of the sanitizing solution and helps prevent pets and children from consuming the solution. The top of the container 30 is formed with an inlet opening 31 that is closed by a removable, vented cap 32 and preferably a screen (not shown) to prevent the introduction of debris into the container 30 when refilling solution therein. On the underside of the container 30, as is best seen in FIGS. 3 and 4, an outlet opening 34 is formed for the discharge of solution from the container 30.

A valve 35 is coupled to the outlet opening 34 to control the discharge of solution from the container 30. When the valve 35 is opened, the solution flows by gravity through the outlet opening 34 and into a pair of opposing flexible conduits 36 that direct the discharged solution into a manifold 37 mounted on the subframe 21. The manifold 37, in turn, is in flow communication with a plurality of dispensing tubes 38 that direct solution into the brush assembly 20 for application to the bottoms of the shoes being cleaned on the cleaning surface 24. The opening and closing of the valve 35 is controlled through a bracket 15 affixed to the subframe 21 to be pivotally movable therewith.

Figure 6:
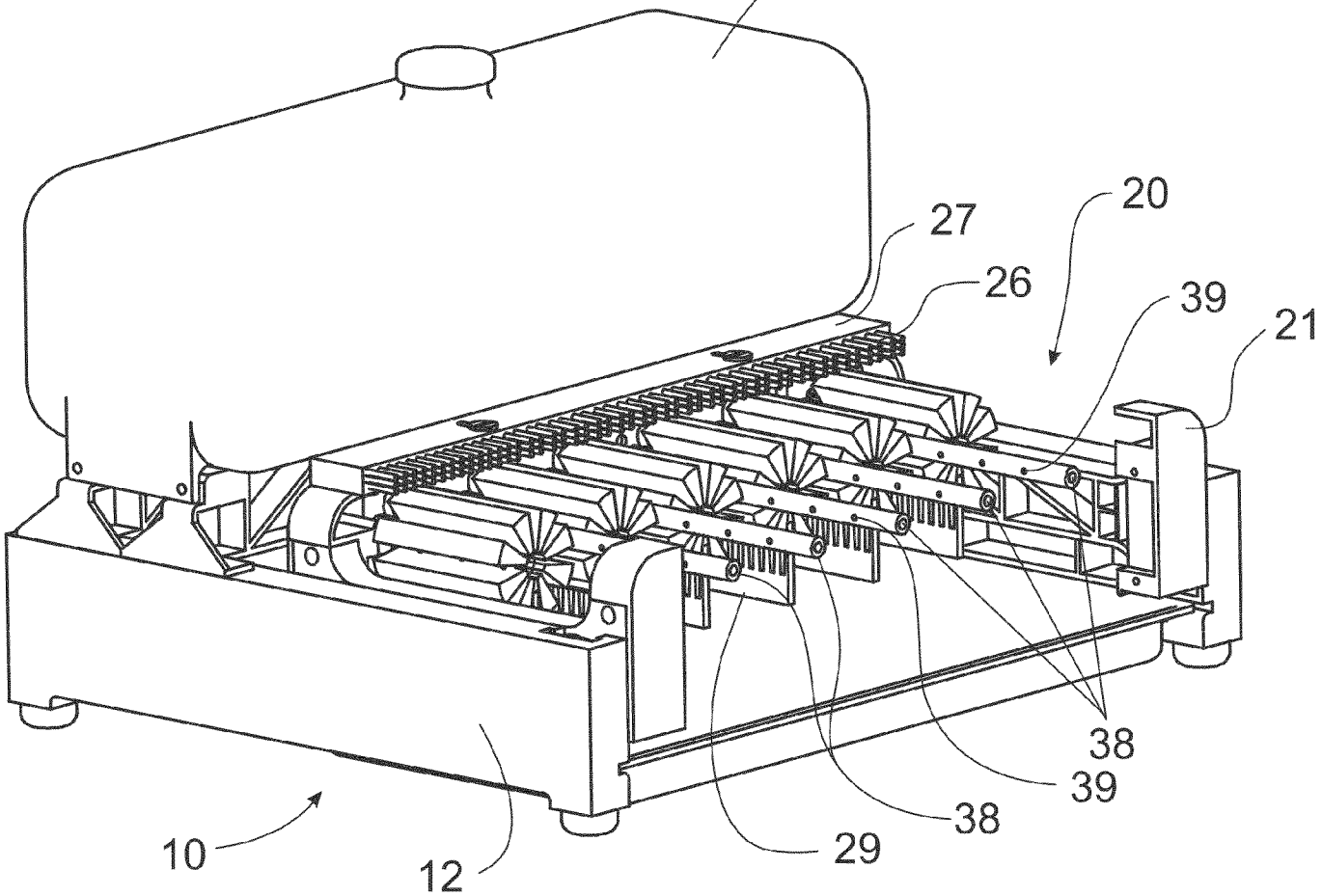
FIG. 6 is a partial perspective view of the shoe cleaning apparatus similar to that of FIG. 5, but having portions of the frame, rotating brush assembly and brush cleaning combs broken away to show a first embodiment of the solution dispensing tubes located between the rotatable brushes.
Figure 7:
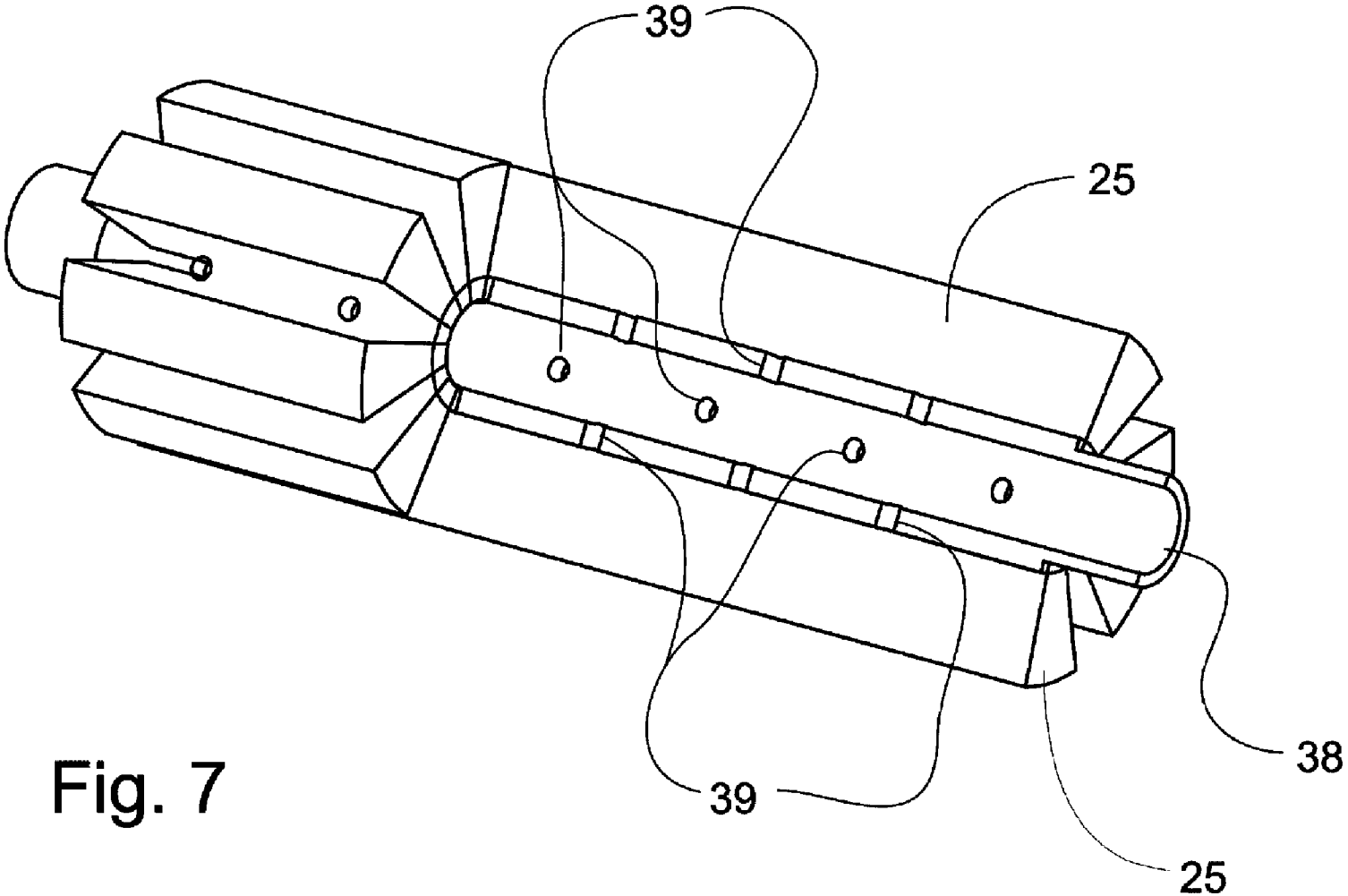
FIG. 7 is a perspective detail view of a second embodiment of the solution dispensing tubes located as the support shaft of the rotatable brushes, a portion of the brush being broken away to view the openings within the support shaft for dispensing the cleaning fluid into the brushes, the brush, as with the other Figs., are depicted schematically to reflect rows of radially extending brush bristles.

The solution dispensing tubes 38 are best seen in FIGS. 6 and 7. In one embodiment shown in FIG. 6, the dispensing tubes 38 are located between cylindrical brushes 25 with solution delivery holes 39 oriented to direct the flow of solution sideways onto the rotating brushes 25, which pick up the solution into the bristles and direct the solution into contact with the soles of the shoes to enhance cleaning and effect a sanitizing thereof. In a second embodiment, shown in FIG. 7, the solution dispensing tubes 38 are formed as the central hollow shafts of the rotating cylindrical brushes 25 so that the solution delivery holes 39 can be located in a regular circumferential pattern to direct the flow of solution outward onto the bristles of the brushes 25 for contact with the soles of the shoes being cleaned.

In operation, the user of the shoe cleaning apparatus 10 places his or her shoe onto the cleaning surface 24 and pressing downwardly onto the cleaning surface 24 rubs the sole of the shoe back and forth across the cleaning surface 24. The pressure of the shoe against the rotatable brushes 25 causes the brushes 25 to rotate with the shoes and affect a scrubbing of the soles with the rotating cylindrical brushes 25. Simultaneously, the side cleaning brushes 26, which are properly positioned or spring-loaded for engagement with the sides of the shoes being cleaned, rub against the sides of the shoes while the shoes are being manually rubbed across the cleaning surface 24. Any dirt and debris being dislodged and removed from the shoe sole or sides is dropped onto the debris tray 14 located below the brush assembly 20.

When more than minimal pressure is applied against the cleaning surface 24, the subframe 21 will pivot about the pivot 22 and cause the opposite end of the subframe to move downwardly approximately ¼-⅜ inches. The downward movement of the free end of the subframe 21 moves the bracket 15 downwardly as well, which results in the release of the valve 35 and the discharge of cleaning/sanitizing solution from the container 30 through the flexible conduits 36, into the manifold 37 and out into the dispensing tubes 38 for delivery to the brushes 25. The movement of the subframe is limited by stops 18, best seen in FIG. 3, on both sides of the frame 12. A pair of corresponding springs 17 bias the subframe 21 upwardly against the pressure exerted during operation to clean shoes on the cleaning surface 24.

The bias force exerted by the springs 17 is greater than the weight of the brush assembly 20 and should preferably resist a predetermined minimal amount of pressure exerted on the cleaning surface 24 by the person whose shoes are being cleaned. Thus, the subframe 21 will pivot downwardly only when sufficient downward force sufficient to overcome the springs 17 is applied. Therefore, cleaning solution will only be dispensed into the brush assembly 20 when the use of the solution is desired. The stops 18 are also operable to prevent damage to the valve 35 from excessive downward pressure, thus allowing the brush assembly to move downwardly a maximum, measured amount. The above-described shoe cleaning apparatus 10 keeps the solution fresh and clean each and every time it is used and also allows the user the option of not using the solution if it is not desired.

The known prior art shoe cleaning devices do not provide a simple and economical shoe cleaner that will utilize manually operable cylindrical brushes 25 that are cooperable with cleaning combs 29 to remove dirt and debris from the bristles for deposit on a removable debris tray 14. The tray 14 is slidably supported in grooves formed in the frame 12 and can include a drain for the discharge of collected moisture and solution from the cleaning operation. The application of the cleaning solution to the brush assembly 20 is operated and controlled by the amount of foot pressure exerted onto the pivoted subframe 21, which in turn controls the operation of a valve 35 controlling the discharge of cleaning solution from a gravity fed reservoir 30 mounted on the frame 12.

The cleaning solution can be applied directly onto the cylindrical brushes 25 from dispensing tubes 38 that can be located between adjacent brushes 25 or as the central shaft defining the axis of rotation of each cylindrical brush 25. The sides of the shoes are cleaned by side cleaning brushes 26 that are supported on the subframe 21 of the brush assembly 20 and can be spring-loaded for engagement with varying widths and sizes of shoes being placed onto the cleaning surface 24. Damage to the valve 35 is avoided by the provision of stops 18 and the biasing force exerted by the spring 17.

A door mat or welcome mat can be used in conjunction with the shoe cleaning device to help remove any remaining solution from shoes. The shoe cleaning device can also be used by itself since the remaining solution will evaporate fairly quickly, particularly is formed as an alcohol based solution.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A shoe cleaning apparatus comprising:

a brush assembly supported on a frame for generally vertical movement relative to said frame, said brush assembly including a plurality of generally cylindrical rotary brushes arranged in a parallel configuration to define a cleaning surface, each said cylindrical brush being rotatable about a transverse axis in response to a sliding movement of a shoe across said rotary brushes defining said cleaning surface, each said rotary brush being formed with a plurality of bristles extending radially from the corresponding said transverse axis;

a tank mounted on said frame to support a supply of cleaning fluid; and a dispensing mechanism coupled to said brush assembly and to said tank to convey cleaning fluid to said brush assembly in response to said vertical movement of said brush assembly corresponding to the placement of said shoe on said cleaning surface, said dispensing mechanism supplying said cleaning fluid beneath said cleaning surface to facilitate the cleaning of a bottom surface of the shoe placed on the cleaning surface.

2. The shoe cleaning apparatus of claim 1 wherein each said cylindrical rotary brush is engaged by a comb device located below said cleaning surface, each said comb including a plurality of elongated teeth extending into the corresponding said rotary brush such that said bristles pass between said teeth to provide resistance to rotation of the corresponding rotary brush and to clean dirt and debris from said rotary brushes.

3. The shoe cleaning apparatus of claim 2 wherein said brush assembly includes a sub-frame pivotally connected to said frame for said generally vertical movement about a transverse pivot axis.

4. The shoe cleaning apparatus of claim 3 wherein said sub-frame is operatively connected to a flow control valve in said dispensing mechanism such that a downward movement of said sub-frame affects a flow of cleaning fluid from said tank to said rotary brushes.

5. The shoe cleaning apparatus of claim 4 wherein said dispensing mechanism further includes a conduit and a manifold to dispense said cleaning fluid to tubes positioned between adjacent pairs of said rotary brushes.

6. The shoe cleaning apparatus of claim 4 wherein said dispensing mechanism further includes a conduit and a manifold to dispense said cleaning fluid into hollow support shafts in each said rotary brush.

7. The shoe cleaning apparatus of claim 4 wherein said sub-frame further supports a pair of transversely spaced side brushes adjustably positionable with respect to said sub-frame and being located above said rotary brushes.

8. The shoe cleaning apparatus of claim 7 wherein said frame further supports a removable tray positionable below said brush assembly to collect material removed from said rotary brushes by said combs.

9. A shoe cleaning apparatus comprising:

a brush assembly including a plurality of generally cylindrical rotary brushes arranged in a parallel transverse array, each said rotary brush having a plurality of radially extending bristles and being supported on a frame for rotational movement about a transverse axis of rotation, said brush assembly including a sub-frame supported on said frame for generally vertical movement relative to said frame; and a plurality of combs supported on said frame below said rotary brushes to be engagable therewith to remove material from said rotary brushes upon rotation thereof, each said comb being formed with elongated teeth that extend into the corresponding brush such that the bristles on each said brush pass between the teeth on the corresponding comb to provide resistance to rotation of the corresponding rotary brush and to clean material from said rotary brushes.

10. The shoe cleaning apparatus of claim 9 further comprising:

a tank mounted on said frame to support a supply of cleaning fluid; and a dispensing mechanism coupled to said sub-frame and to said tank to convey cleaning fluid to said brush assembly in response to said generally vertical movement of said brush assembly.

11. The shoe cleaning apparatus of claim 10 wherein said dispensing mechanism includes a flow control valve and conduits, said sub-frame being operatively connected to said flow control valve so that a downward movement of said sub-frame actuates said flow control valve to release cleaning fluid from said tank to said rotary brushes.

12. The shoe cleaning apparatus of claim 11 wherein said dispensing mechanism further includes a manifold and dispensing tubes to direct said cleaning fluid between adjacent pairs of said rotary brushes.

13. The shoe cleaning apparatus of claim 11 wherein said dispensing mechanism further includes a manifold that dispenses said cleaning fluid into hollow support shafts defining said transverse axis of rotation in each said rotary brush.

14. The shoe cleaning apparatus of claim 13 wherein said sub-frame further supports a pair of transversely opposed side brushes adjustably positionable with respect to said sub-frame and being located above said rotary brushes.

15. A shoe cleaning apparatus comprising:

a brush assembly having a sub-frame pivotally supported on a frame for generally vertical movement about a pivot axis relative to said frame, said brush assembly including a plurality of generally cylindrical rotary brushes arranged in a parallel configuration to define a cleaning surface, each said cylindrical brush being rotatable about a transverse axis in response to a sliding movement of a shoe across said rotary brushes defining said cleaning surface, each said rotary brush being formed with a plurality of bristles extending radially from the corresponding said transverse axis;

each said cylindrical rotary brush being engaged by a comb device located below said cleaning surface, each said comb including a plurality of elongated teeth extending into the corresponding said rotary brush such that said bristles pass between said teeth to provide resistance to rotation of the corresponding rotary brush and to clean dirt and debris from said rotary brushes;

a biasing mechanism connected to said sub-frame to resist downward pivotal movement of said sub-frame;

a tank mounted on said frame above said brush assembly to support a supply of cleaning fluid; and a dispensing mechanism including a flow control valve coupled to said sub-frame and to said tank to convey cleaning fluid to said brush assembly in response to said vertical movement of said brush assembly to a preselected position in response to the placement of the shoe on said cleaning surface, said dispensing mechanism supplying said cleaning fluid beneath said cleaning surface to facilitate the cleaning of a bottom surface of the shoe placed on the cleaning surface.

16. The shoe cleaning apparatus of claim 15 wherein said dispensing mechanism further includes a manifold that dispenses said cleaning fluid into hollow support shafts defining said transverse axis of rotation in each said rotary brush.

17. The shoe cleaning apparatus of claim 16 wherein said sub-frame further supports a pair of transversely opposed side brushes adjustably positionable with respect to said sub-frame and being located above said rotary brushes.

* * * * *